United States Patent [19]

Kimura et al.

[11] Patent Number: 4,838,766

[45] Date of Patent: Jun. 13, 1989

[54] METHOD FOR CONTROLLING DISPLACEMENT OF A VARIABLE DISPLACEMENT WOBBLE PLATE TYPE COMPRESSOR

[75] Inventors: Kazuya Kimura; Akira Nakamoto; Jun Hasegawa, all of Kariya, Japan

[73] Assignee: Kabushiki Kaisha Toyoda Jidoshokki Seisakusho, Aichi, Japan

[21] Appl. No.: 128,269

[22] Filed: Dec. 3, 1987

[30] Foreign Application Priority Data

Dec. 5, 1986 [JP] Japan ..... 61-291140

[51] Int. Cl.[4] ..... F04B 1/26

[52] U.S. Cl. ..... 417/222; 417/270

[58] Field of Search ..... 417/222 S, 270

[56] References Cited

U.S. PATENT DOCUMENTS 4,132,086 2/1979 Kountz ..... 417/222 S
4,533,299 8/1985 Swain ..... 417/222 S
4,685,866 8/1987 Takenaka et al. ..... 417/222 S
4,730,986 3/1988 Kayukawa ..... 417/270
4,747,754 5/1988 Fujii ..... 417/270

FOREIGN PATENT DOCUMENTS 162087 8/1985 Japan ..... 417/222 S
2153922 8/1985 United Kingdom ..... 417/222 S

*Primary Examiner*—William L. Freeh
*Attorney, Agent, or Firm*—Burgess, Ryan & Wayne

[57] ABSTRACT

A method for controlling the compressor displacement of a variable displacement wobble plate type compressor having a solenoid-operated control valve unit for controlling the pressure level of a crankcase chamber of the compressor by controlling the duty ratio of an electric pulsive current to energize the solenoid-operated control valve unit, the frequency of the electric pulsive current being set and maintained at a low frequency, such as a frequency equal to or less than 1.0 Hz.

3 Claims, 6 Drawing Sheets

METHOD FOR CONTROLLING DISPLACEMENT OF A VARIABLE DISPLACEMENT WOBBLE PLATE TYPE COMPRESSOR

BACKGROUND OF THE INVENTION

1. Field of the Invention

The present invention relates to a method for controlling the displacement or capacity of a wobble plate type compressor with a wobble angle control unit for adjustably changing an angle of the wobble plate in the crankcase of the compressor by changing a fluid pressure level within the crankcase, and more particularly, relates to a method of controlling the operation of a solenoid-operated fluid-flow control valve of the wobble angle control unit, which valve is operated by an electric current supplied in the form of pulses the duty ratio of which is changed in response to a change in the requirement for compressor displacement.

2. Description of the Related Art

Many variable displacement wobble plate type compressors with a wobble angle control unit are known. For example, U.S. Pat. No. 4,685,866 to Takenaka et al discloses a variable displacement wobble plate type compressor having a crankcase for receiving a variable angle wobble plate mechanism for driving the reciprocatory movement of pistons and a wobble angle control unit accommodated in a housing for defining a suction chamber for refrigerant before compression and a discharge chamber for refrigerant after compression. The wobble angle control unit includes a fluid flow control valve with which a fluid pressure level within the crankcase is changed, thereby causing a change in a wobble angle of the wobble plate. The fluid flow control valve of U.S. Pat. No. 4,685,866 is operated by a pressure-sensitive movable valve mechanism.

A pending U.S. patent application Ser. No. 093,797, filed on Sept. 4, 1987 discloses a variable displacement wobble plate type compressor with a solenoid-operated wobble angle control unit for adjustably changing the angularity of the wobble plate, to thereby control the compressor displacement.

FIG. 1 illustrates the general mechanical construction of the variable displacement wobble plate type compressor of the pending U.S. patent application Ser. No. 093,797. The compressor 1 has a cylinder block 2 having cylinder bores in which pistons 3 are reciprocated, a crankcase 4 having therein a chamber 5 for receiving a wobble plate assembly including a rotatable drive plate 9*a* supported on a drive shaft 9*c* and a non-rotary variable angle wobble plate 9*b* for driving the reciprocating movement of the pistons 3, a housing 6 having therein a suction chamber 7 and a discharge chamber 8, and a solenoid-operated wobble angle control unit including a solenoid-operated valve means 10 accommodated in the housing 6. The solenoid valve means 10 of the solenoid-operated wobble angle control unit is arranged for control of the fluid communication between the crankcase chamber 5 and the discharge chamber 8 by means of a fluid passageway 11 in response to a change in the cooling load of the compressor. The solenoid valve means 10 has a solenoid element which can be energized and de-energized in response to an external control signal. A fluid passageway 12 is arranged for communicating the crankcase chamber 5 and the suction chamber 7 of the housing 6 as required.

The solenoid-operated valve means 10 of the solenoid-operated wobble angle control unit changes a fluid pressure level Pc within the chamber 5 of the crankcase 4 which acts on the back faces of the pistons 3, to thereby cause a change of a pressure differential (Pc−Ps) between the fluid pressure Pc and the pressure Ps in the suction chamber 7. When the pressure differential (Pc−Ps) is larger than a predetermined pressure level, the stroke of each piston 3 is decreased to vary the angularity of the wobble plate 9*b* toward an erected position from an inclined position. Thus, the compressor displacement is decreased. On the other hand, when the pressure differential (Pc−Ps) is much smaller than the predetermined pressure level, the stroke of each piston 3 is increased to move the wobble plate 9*b* toward the inclined position, and the compressor displacement is increased. At this stage, as stated above, the operation of the solenoid-operated valve means 10 of the solenoid-operated wobble angle control unit is controlled by energizing and de-energizing the solenoid element thereof. However, the conventional method of energizing and de-energizing the solenoid-operated valve means 10 is conducted by changing the duty ratio $\delta$ of an electric excitation current supplied to the solenoid element in the form of pulses having a predetermined frequency value (f) selected from the range from two to ten or more hertz (Hz). The duty ratio $\delta$ is defined by the following equation, i.e., $\delta = t/T$, where t indicates the time period in which the electric excitation current of each pulse appears, and corresponds to the width of the electric pulsive current, and T indicates each time cycle of the electric pulsive current and is equal to 1/f. Therefore, changing the duty ratio of the pulsive electric excitation current means changing the time period t in which the electric excitation current of each pulse appears. However, with the above-mentioned conventional method, changing the duty ratio $\delta$ of the electric pulsive excitation current will not cause an immediate change in the angularity of the wobble plate 9*b*, i e., an immediate change in the compressor displacement. Thus, the present inventors carried out research and conducted experiments to determine how to overcome the inability of the conventional method to control the compressor displacement of a variable displacement wobble plate type compressor by controlling the duty ratio on the solenoid-operated valve means 10. As a result, it was discovered that, when a control of the duty ratio of the electric pulsive excitation current for the solenoid-operated valve 10 is carried out so as to adjustably change the pressure level Pc in the chamber 5 of the crankcase 4, to thereby change the angularity of the wobble plate 9*b*, a frictional force generated between the wobble plate 9*b* and the associated various mechanical elements prevents an immediate movement of the wobble plate 9*b* in response to a change in the pressure level Pc in the crankcase chamber 5. Namely, since the frequency (f) of the electric pulsive current for energizing the solenoid operated valve means 10 is from two to ten or more hertz, which is rather high, as will be understood from the illustration of FIG. 6, the time cycle (T) of the electric pulsive current is small. Therefore, as illustrated in FIG. 7, when the duty ratio is maintained at a value between 0 to 1.0, the pressure level Pc within the crankcase chamber 5 is maintained at a very stable level in the form of an extremely small wave. Accordingly, even if the duty ratio $\delta$ of the electric pulsive current having the small time cycle (T) is slightly changed, an appreciable change in the pressure level (Pc) within the crankcase chamber 5, which can change the angularity of the wobble plate 9b by overcoming the friction force, does not occur. That is, when the angularity of the wobble plate 9b is changed from an inclined position to an erect position, and vice versa, the pressure level (Pc) within the crankcase chamber 5 must come out of a specified pressure range between the two high and low pressure levels Pc1 and Pc2 which are defined as the pressure levels necessary for commencing the erecting and inclining movement of the wobble plate 9 against a friction force. However, the slight increase or decrease alone of the duty ratio δ of the electric pulsive current cannot bring about a sufficient change in the pressure level Pc over the pressure level Pc1 or below the pressure level Pc2. Accordingly, although the duty ratio δ per se might be successively changed, the angularity of the wobble plate 9b cannot be successively changed in a direct relationship with the change of the duty ratio δ. Consequently, when it is necessary to change the angularity of the wobble plate to control the compressor displacement, the duty ratio δ must be unduly increased or decreased until the pressure level Pc prevailing in the crankcase chamber 5 is appropriate for commencing a movement of the wobble plate 9b while overcoming the above-mentioned friction force. At this stage, however, due to this undue change of the duty ratio, the movement of the wobble plate 9b for changing the angularity thereof always results in an overshoot of a desired angular position of the wobble plate 9b. Therefore, conventionally it takes rather long time to control the compressor displacement by changing the duty ratio of the electric pulsive energizing current of the solenoid-operated valve means 10 of the solenoid-operated wobble angle control unit.

SUMMARY OF THE INVENTION

An object of the present invention is, therefore, to obviate the defects encountered by the conventional method for controlling the compressor displacement of a variable angle wobble plate type compressor.

Another object of the present invention is to provide a method for controlling the compressor displacement of a variable angle wobble plate type compressor whereby the wobble plate angularity can be smoothly and continuously changed so as to achieve a stable and accurate control of the compressor displacement.

In accordance with the present invention, there is provided a method for controlling the compressor displacement of a variable displacement wobble plate type compressor of the type including a housing element having therein a suction chamber for a refrigerant to be compressed and a discharge chamber for a compressed refrigerant; a cylinder block defining therein a plurality of cylinder bores in which associated reciprocatory pistons are disposed to draw the refrigerant from the suction chamber and then discharge the refrigerant after compression to the discharge chamber; a closed crankcase defining therein a chamber for an assembly of wobble and drive plates to drive the reciprocatory pistons; a first passageway for fluidly communicating the crankcase chamber with the discharge chamber; a second passageway for fluidly communicating the crankcase chamber with the suction chamber; and a solenoid-operated control valve unit arranged in the first passageway and energized by an electric pulsive current to control the amount of compressed refrigerant flowing from the discharge chamber to the crankcase chamber, thereby adjustably changing a pressure differential between a pressure in the crankcase chamber and a pressure in the suction chamber, which pressure differential changes the stroke length of the pistons while changing the angularity of the assembly of wobble and drive plates and the compressor displacement, comprising the steps of:

energizing the solenoid-operated control valve unit by an electric pulsive current having a given duty ratio (δ);

setting and holding the frequency (f) of the electric pulsive current at a predetermined low value so that the pressure in the crankcase chamber changes within a pressure range between first and second predetermined pressure levels, wherein the first and second pressure levels are defined as pressure levels preventing the commencing of a change of the angularity of the assembly of wobble and drive plates the assembly from an angular position determined by the preselected duty ratio;

maintaining the given duty ratio (δ) of the electric pulsive current for the solenoid-operated control valve unit so that the assembly of wobble and drive plates is held at an angular position determined by the given duty ratio (δ); and controlling the duty ratio (67 ) of the electric pulsive current having a preselected frequency value from the given duty ratio value so as to adjustably change the pressure differential, thereby changing the angularity of the assembly of wobble and drive plates in response to a required compressor displacement.

Preferably, the preselected low value of the frequency (f) of the electric pulsive current for energizing the solenoid-operated control valve unit is less than 1.0 Hz.

BRIEF DESCRIPTION OF THE DRAWINGS

Other objects, features and advantages of the present invention will be made more apparent from the ensuing description of the present invention with reference to the accompanying drawings wherein.

DESCRIPTION OF THE REFERRED EMBODIMENT

Figure 1:
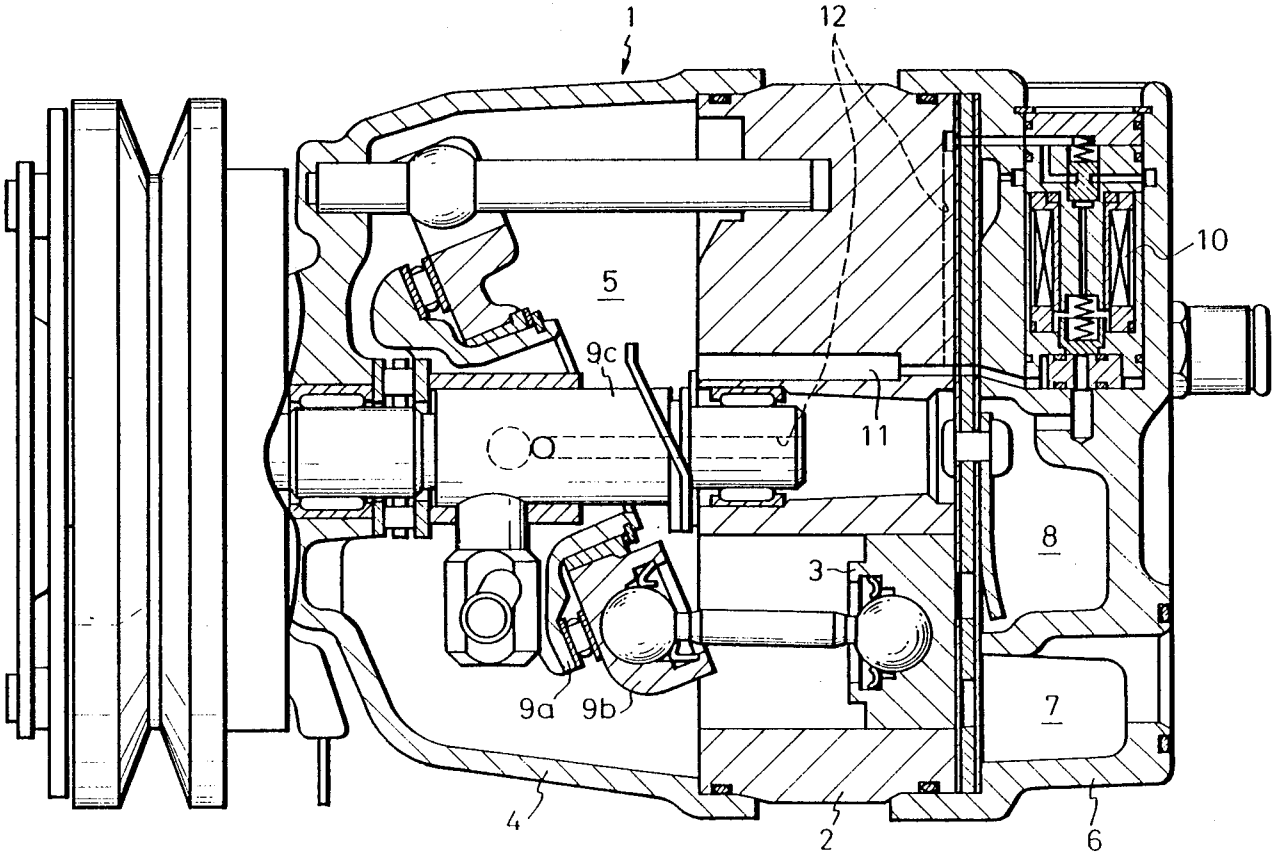
FIG. 1 is a longitudinal cross-sectional view of a variable angle wobble plate type compressor, illustrating a general construction of the compressor.

The following description of an embodiment of the present invention will be provided for the case where the controlling method is applied to the variable displacement wobble plate type compressor illustrated in FIG. 1.

Figure 2:
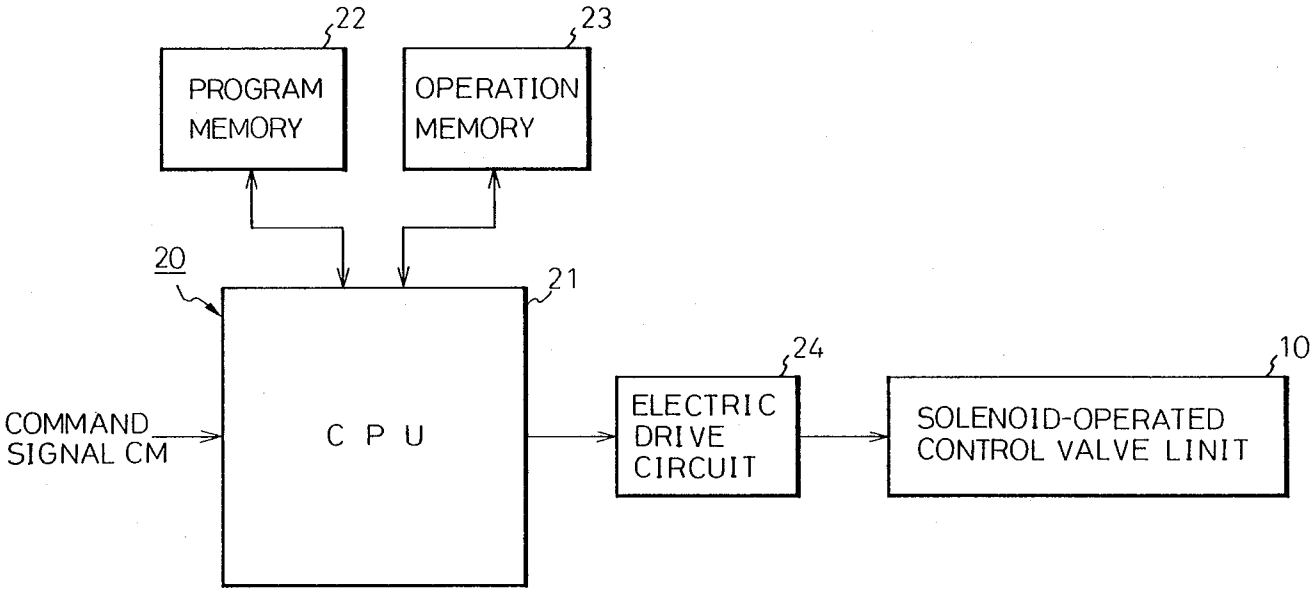
FIG. 2 is a schematic block diagram of an electric circuit arrangement for controlling the operation of the solenoid-operated control valve unit of the variable angle wobble plate type compressor as illustrated in FIG. 1.

Referring to FIG. 2, which illustrates an electric circuit arrangement for controlling the operation of the solenoid-operated control valve to thereby eventually control the compressor displacement of the compressor, the circuit arrangement includes a microcomputer 20 having a central process unit (CPU) 21, a program memory 22 consisting of a read-only-memory (ROM) storing therein a control program, and an operation memory 23 consisting of a random-access memory (RAM) to temporarily store a result of a computation by the CPU 21. The control program of the program memory 22 is formed as a special program from which the CPU 21 can derive information about the relationship between the compressor displacement of the compressor and the duty ratio δ of the electric pulsive current for energizing the solenoid-operated control valve unit 10 under various frequencies of the electric pulsive current. Therefore, when an external command signal CM indicating a desired compressor displacement determined by the operating condition of the air-conditioning circuit in which the compressor is accommodated is received, the CPU 21 processes the computation for obtaining an operating condition to control and drive the solenoid-operated control valve unit 10 on the basis of the control program of the program memory 22. That is, the CPU 21 calculates the duty ratio δ of the electric pulsive current corresponding to the desired compressor displacement indicated by the command signal CM, and sends an output signal to an electric drive circuit 24 on the basis of the calculated duty ratio δ. The output signal is a control signal for driving the electric drive circuit 24 so that the circuit 24 energizes the solenoid-operated control valve unit 10 by the electric pulsive current under the calculated duty ratio δ.

Figure 8:
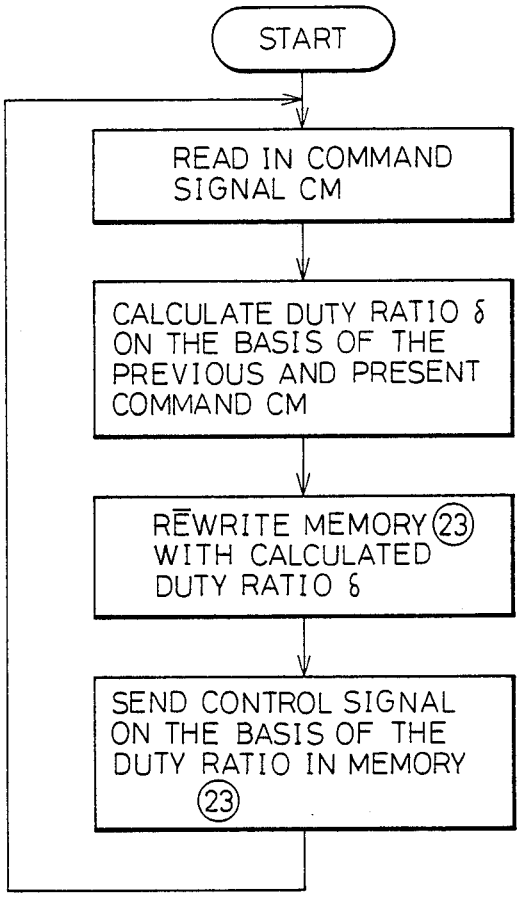
FIG. 8 is an operational flow chart of the microcomputer of the electric circuit arrangement of FIG. 2.

The operational flow of the CPU 21 of the microcomputer 20 is illustrated in FIG. 8. When the operation is started, the CPU 21 initially reads the protocol of the operation from the program memory 22. Then, the CPU 21 reads the command signal CM appearing at the input port thereof in a sample manner. When the command signal CM is read, the above-mentioned calculation for obtaining the duty ratio δ of the electric pulsive current corresponding to the desired compressor displacement indicated by the command signal CM is carried out according to the known equation set forth below.

$$\text{Duty ratio}\,\delta = Kp \cdot e + Ki \cdot \int e\,dt + Kd \cdot de/dt$$

$$e = Tr - Te$$

where Kp, Ki, and Kd are constant, Tr is an objective temperature of the air-conditioning system employing the variable displacement wobble plate type compressor, and Te is a temperature detected at the output of an evaporator of the air-conditioning system, the information of Tr and Te being included in the previous and present command signals CM.

The calculated duty ratio δ is sent to the operation memory 23 to rewrite the content stored in the memory 23. Then, the CPU 21 issues a control signal, on the basis of the rewritten content of the operation memory 23, to the electric drive circuit 24.

Figure 3:
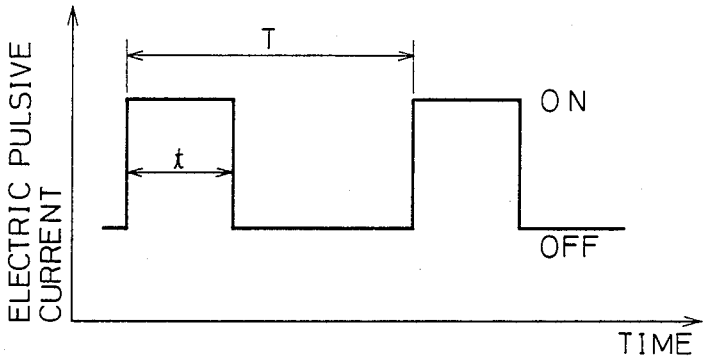
FIG. 3 is a diagram illustrating a wave form of an electric pulsive current for energizing the solenoid-operated control valve unit of the compressor, as an embodiment of the method of the present invention.
Figure 4:
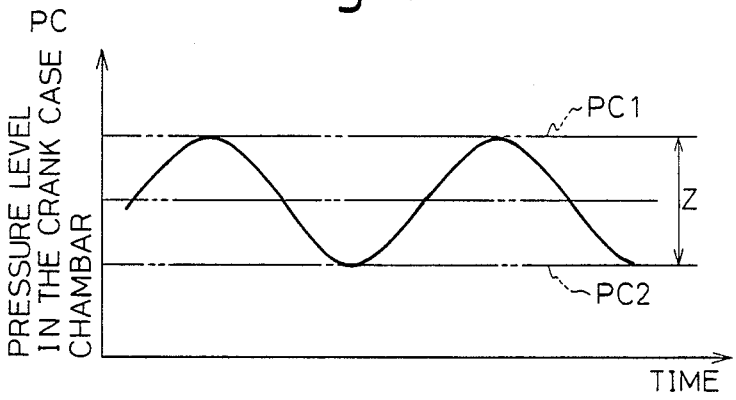
FIG. 4 is a diagram illustrating the pressure condition in the crankcase chamber of the compressor when the method of the present invention is carried out.

At this stage, the electric drive circuit 24 is automatically or manually adjusted by an appropriate adjusting means (not shown) so that the electric pulsive current has a predetermined constant low frequency $f_0$, i.e., a long time cycle ($T=1/f_0$) as illustrated in FIG. 3. It should be understood that the time cycle T is set so that when the solenoid-operated control valve unit 10 is energized by the electric pulsive current having the frequency $f_0$ (Hz) under a given duty cycle value, a pressure level PC within the chamber 5 of the crankcase 4 (FIG. 1) is varied to show a wave form confined within a control pressure range Z between first and second pressure levels $PC_1$ and $PC_2$ as illustrated in FIG. 4. The control pressure range Z is defined as a specified pressure range preventing the assembly of the drive and wobble plates **9*a* and 9*b* from commencing to move toward an erect position approximately vertical to the axis of the compressor drive shaft 9*c***, and an inclined position slanted from the erect position. The above-mentioned time cycle T can be preliminarily determined by a test conducted on the compressor.

When the duty ratio δ of the electric pulsive current is changed from the given duty ratio value, the pressure level PC within the crankcase chamber 5 changes from the condition as illustrated in FIG. 4. That is, since the wave form of the pressure level PC goes entirely up or down from the condition of FIG. 4, there appears a case wherein an instant pressure level PC within the crankcase chamber 5 is higher than the pressure level $PC_1$ or lower than the pressure level $PC_2$. As a result, the pressure differential between the pressure within the crankcase chamber 5 and the suction chamber 7 becomes sufficient for quickly moving the assembly of the drive and wobble plates **9*a* and 9*b*** from the angular position corresponding to the above-mentioned given duty ratio value to an angular position corresponding to the changed duty ratio value.

Figures 5A, 5B, 5C:
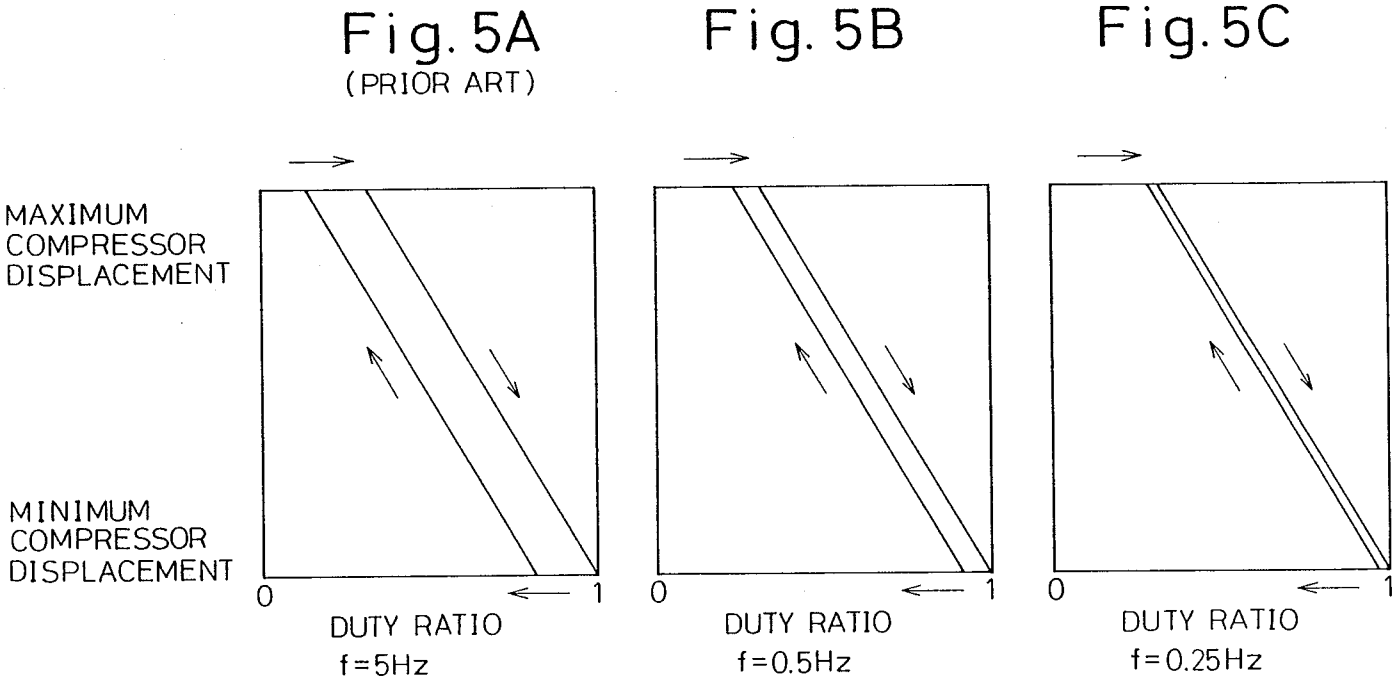
Fig. 5A (PRIOR ART)
FIGS. 5A through 5C are graphs illustrating the relationship between the duty ratio of the electric pulsive current for energizing the solenoid-operated control valve unit of the compressor and the compressor displacement under various frequencies of the electric pulsive current.
Figure 6:
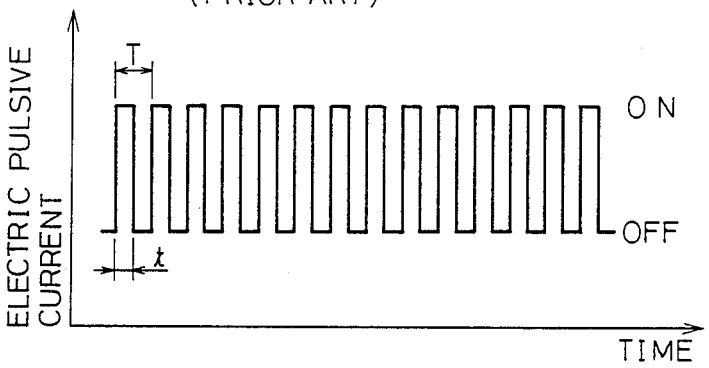
Fig.6 (PRIOR ART)
FIG. 6 is a diagram illustrating a wave form of an electric pulsive current for energizing the solenoid-operated control valve unit of the compressor, used for carrying out the conventional control method.
Figure 7:
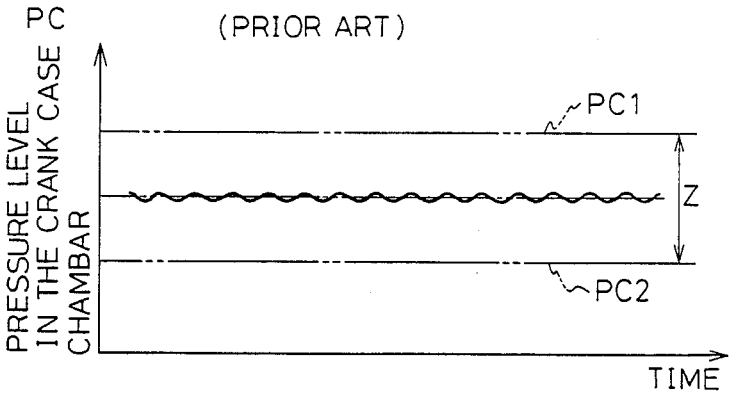
Fig.7 (PRIOR ART)
FIG. 7 is a diagram illustrating the pressure condition in the crankcase chamber of the compressor when the conventional control method is carried out.

FIGS. 5A through 5C indicate three test results of a change in the compressor displacement in response to a gradual change in the duty ratio of from 0 to 1.0 and then from 1.0 to 0 under the different test conditions set forth below.

The test conditions of FIG. 5A are as follows, i.e., the compressor was rotated at 1,000 r.p.m, and the solenoid-operated control valve unit 10 is energized by an electric pulsive current having a 5 Hz frequency f.

The test conditions of FIG. 5B are as follows, i.e., the compressor was rotated at 1,000 r.p.m, and the solenoid-operated control valve unit 10 is energized by an electric pulsive current having a 0.5 Hz frequency.

The test conditions of FIG. 5C are as follows, i.e., the compressor was rotated at 1,000 r.p.m, and the solenoid-operated control valve unit 10 is energized by an electric pulsive current having a 0.25 Hz frequency.

From the comparison of the test results of FIGS. 5A through 5C, it will be understood that the lower the frequency f of the electric pulsive current, the less hysteresis occurs in the change in the compressor displacement according to the change in the duty ratio. That is, the response characteristics of the compressor displacement according to the change in the duty ratio is appreciably improved in response to the employment of the low frequency values 0.5 Hz and 0.25 Hz of the electric pulsive current, compared to the case of the employment of the conventional 5 Hz frequency.

It was generally confirmed that when the frequency f is equal to or less than 1 Hz, the compressor displacement of the variable displacement wobble type compressor can be controlled by changing the duty ratio δ of the electric pulsive current for energizing the solenoid operated control valve unit 10. Specifically, when the frequency value between 0.1 Hz and 0.5 Hz is employed, the compressor displacement is more effectively controlled, and when the frequency is set at a value between 0.15 Hz and 0.25 Hz, the control of the compressor displacement is at an optimum.

From the foregoing description of the control method as an embodiment of the present invention, it will be understood that, when the compressor displacement of the variable displacement wobble plate type compressor is controlled by changing the duty ratio δ of the electric pulsive current for energizing the solenoid-operated control valve unit 10 of the compressor, since the frequency f of the pulsive current is intentionally set at a low value, i.e., a long time cycle T, a change in the pressure level PC within the crankcase chamber 5 of the compressor can be always held at a critical condition allowing the assembly of the drive and wobble plates to commence the movement thereof toward a desired angularity. Therefore, the control of the compressor displacement by changing the angularity of the assembly of the drive and wobble plates can be smoothly and accurately realized. Moreover, since the solenoid-operated control valve unit 10 is always energized by an electric pulsive current having a low frequency, the frequency of opening and closing of the control valve unit 10 can be low, and accordingly, the operational life of the solenoid-operated control valve unit can be long compared with the valve unit operated by the conventional method.

We claim:

1. A method for controlling the compressor displacement of a variable displacement wobble plate type compressor of the type including a housing element having therein a suction chamber for a refrigerant to be compressed and a discharge chamber for a compressed refrigerant; a cylinder block defining therein a plurality of cylinder bores in which associated reciprocatory pistons are disposed to draw the refrigerant from the suction chamber and then discharge the refrigerant after compression to the discharge chamber; a closed crankcase defining therein a chamber for an assembly of wobble and drive plates to drive the reciprocatory pistons; a first passageway for fluidly communicating the crankcase chamber with the discharge chamber; a second passageway for fluidly communicating the crankcase chamber with the suction chamber; and a solenoid-operated control valve unit arranged in the first passageway and energized by an electric pulsive current to control the amount of compressed refrigerant flowing from the discharge chamber to the crankcase chamber, thereby adjustably changing a pressure differential between a pressure in the crankcase chamber and a pressure in the suction chamber, which pressure differential changes the stroke length of the pistons while changing the angularity of the assembly of wobble and drive plates and the compressor displacement, comprising the steps of:

energizing said solenoid-operated control valve unit by an electric pulsive current having a given duty ratio (δ);

setting and holding a frequency (f) of said electric pulsive current at a predetermined low value equal to or less than 1 Hz so that said pressure in said crankcase chamber changes within a pressure range between a first and a second predetermined pressure levels, wherein said first and second pressure levels are defined as pressure levels preventing a commencing of a change of the angularity said assembly of wobble and drive plates from an angular position determined by said preselected duty ratio;

maintaining said given duty ratio (δ) of said electric pulsive current for said solenoid-operated control valve unit so that said assembly of wobble and drive plates is held at an angular position determined by said given duty ratio (δ); and controlling said duty ratio (δ) of said electric pulsive current having said preselected frequency value from said given duty ratio value to adjustably change said pressure differential, thereby changing said angularity of the assembly of wobble and drive plates in response to a required compressor displacement.

2. A method for controlling the compressor displacement of a variable displacement wobble plate type compressor according to claim 1, wherein said predetermined low value of the frequency (f) of said electric pulsive current is between 0.1 Hz and 0.5 Hz.

3. A method for controlling the compressor displacement of a variable displacement wobble plate type compressor according to claim 2, wherein said predetermined low value of the frequency (f) of said electric pulsive current is between 0.15 Hz and 0.25 Hz.

* * * * *